US011879307B2

(12) United States Patent
Alexander et al.

(10) Patent No.: US 11,879,307 B2
(45) Date of Patent: Jan. 23, 2024

(54) OBJECT CARRIER, TOOL, METHOD, AND SYSTEM

(71) Applicants: David Alexander, Houston, TX (US); Knut Inge Dahlberg, Tomball, TX (US); Eivind Hagen, Rogaland County (NO)

(72) Inventors: David Alexander, Houston, TX (US); Knut Inge Dahlberg, Tomball, TX (US); Eivind Hagen, Rogaland County (NO)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 67 days.

(21) Appl. No.: 17/668,907

(22) Filed: Feb. 10, 2022

(65) Prior Publication Data

US 2023/0250707 A1 Aug. 10, 2023

(51) Int. Cl.
*E21B 34/14* (2006.01)
*E21B 23/02* (2006.01)
(Continued)

(52) U.S. Cl.
CPC ..... *E21B 34/14* (2013.01); *E21B 23/02* (2013.01); *E21B 23/06* (2013.01); *E21B 29/002* (2013.01); *E21B 2200/04* (2020.05)

(58) Field of Classification Search
CPC ..... E21B 34/14; E21B 23/02; E21B 23/06; E21B 29/002; E21B 2200/04
See application file for complete search history.

(56) References Cited

U.S. PATENT DOCUMENTS 4,648,448 A * 3/1987 Sanford ..... E21B 23/006 166/187
4,893,678 A * 1/1990 Stokley ..... E21B 34/14 166/239

(Continued)

OTHER PUBLICATIONS

Notification of Transmittal of the International Search Report and the Written Opinion of the International Searching Authority, or the Declaration; PCT/US2023/012609; dated May 26, 2023; 8 pages.

*Primary Examiner* — Steven A MacDonald
(74) *Attorney, Agent, or Firm* — CANTOR COLBURN LLP

(57) ABSTRACT

An object carrier including a housing having a bore with a diametrically larger portion and a diametrically smaller portion, an object keeper having a first and a second end, the first end being initially disposed in the diametrically smaller portion, an actuator assembly configured to move the first end of the object keeper from the diametrically smaller portion to the diametrically larger portion responsive to selected application of pressure, and an object disposed within the object keeper and secured within the object keeper while the first end of the object keeper is in the diametrically smaller portion, the object being released from the object keeper upon the first end of the object keeper moving to the diametrically larger portion. A method for managing an object-based operation downhole of a restriction including pressuring up on the object carrier, withdrawing the first end from the diametrically smaller portion, and releasing the object.

18 Claims, 5 Drawing Sheets

(51) Int. Cl.
*E21B 29/00* (2006.01)
*E21B 23/06* (2006.01)

(56) References Cited

U.S. PATENT DOCUMENTS 5,018,580 A * 5/1991 Skipper ..... E21B 10/322 175/269
5,392,862 A * 2/1995 Swearingen ..... E21B 10/322 166/239
6,220,360 B1 * 4/2001 Connell ..... E21B 23/04 166/373
6,634,428 B2 * 10/2003 Krauss ..... E21B 34/108 166/317
8,215,401 B2 7/2012 Braekke et al.
8,807,227 B2 * 8/2014 Fould ..... E21B 47/117 166/373
10,954,732 B2 3/2021 Hern et al.
2002/0162661 A1 * 11/2002 Krauss ..... E21B 34/108 166/318
2004/0020652 A1 * 2/2004 Campbell ..... E21B 43/14 166/313
2008/0093080 A1 * 4/2008 Palmer ..... E21B 21/103 166/318
2008/0128169 A1 * 6/2008 Radford ..... E21B 10/322 175/57
2010/0132954 A1 6/2010 Telfer
2011/0030968 A1 * 2/2011 Xu ..... E21B 34/142 166/373
2011/0232915 A1 9/2011 Kellner et al.
2014/0352970 A1 * 12/2014 Kristoffer ..... E21B 43/12 166/318
2015/0226031 A1 * 8/2015 Hekelaar ..... E21B 34/142 166/374
2016/0040508 A1 * 2/2016 Webster ..... E21B 23/04 166/244.1
2016/0115765 A1 * 4/2016 Brække ..... E21B 34/142 166/318
2016/0362962 A1 * 12/2016 Gonzalez ..... E21B 34/14
2017/0009546 A1 * 1/2017 Krieg ..... E21B 29/005
2017/0058612 A1 * 3/2017 Adams ..... E21B 10/322
2019/0226294 A1 * 7/2019 Hansen ..... E21B 10/322
2020/0291748 A1 * 9/2020 Ali ..... E21B 29/06

* cited by examiner

OBJECT CARRIER, TOOL, METHOD, AND SYSTEM

BACKGROUND

In the resource recovery and fluid sequestration industries, it is common to use dropped objects to restrict or divert flow in order to undertake an operation. Sometimes using drop objects becomes problematic where restrictions or a smaller opening diameter than the object exist in a string through which the object would be dropped. Clearly, in such situations, the object would be prevented from reaching the intended target lying beyond the noted restriction. Careful planning in construction of the string can avoid the problem by using different size objects but reduced complexity in designing and executing operations would be preferable. The art then would well receive alternative solutions.

SUMMARY

An embodiment of an object carrier including a housing having a bore with a diametrically larger portion and a diametrically smaller portion, an object keeper having a first and a second end, the first end being initially disposed in the diametrically smaller portion, an actuator assembly configured to move the first end of the object keeper from the diametrically smaller portion to the diametrically larger portion responsive to selected application of pressure, and an object disposed within the object keeper and secured within the object keeper while the first end of the object keeper is in the diametrically smaller portion, the object being released from the object keeper upon the first end of the object keeper moving to the diametrically larger portion.

An embodiment of a method for managing an object-based operation downhole of a restriction including pressuring up on the object carrier, withdrawing the first end from the diametrically smaller portion, and releasing the object.

An embodiment of a borehole system including a borehole in a subsurface formation, a string in the borehole, and an object carrier disposed within or as a part of the string.

An embodiment of a downhole arrangement comprising the object carrier and a downhole tool actuatable by the object.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
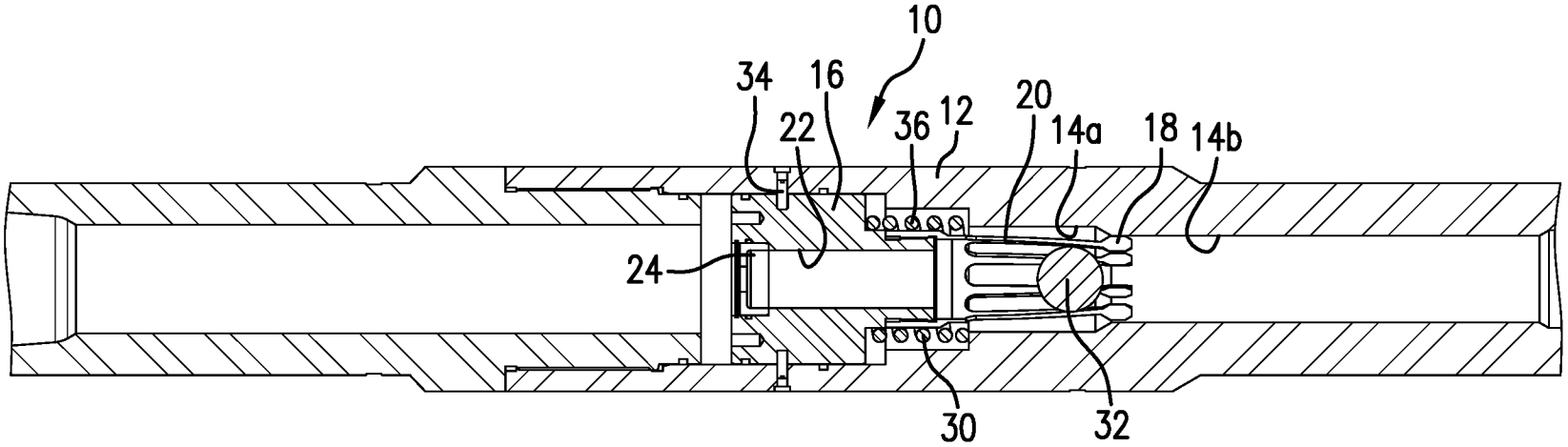
FIG. 1 is a side sectional view of an object carrier as disclosed herein in a run in position.
Figure 2:
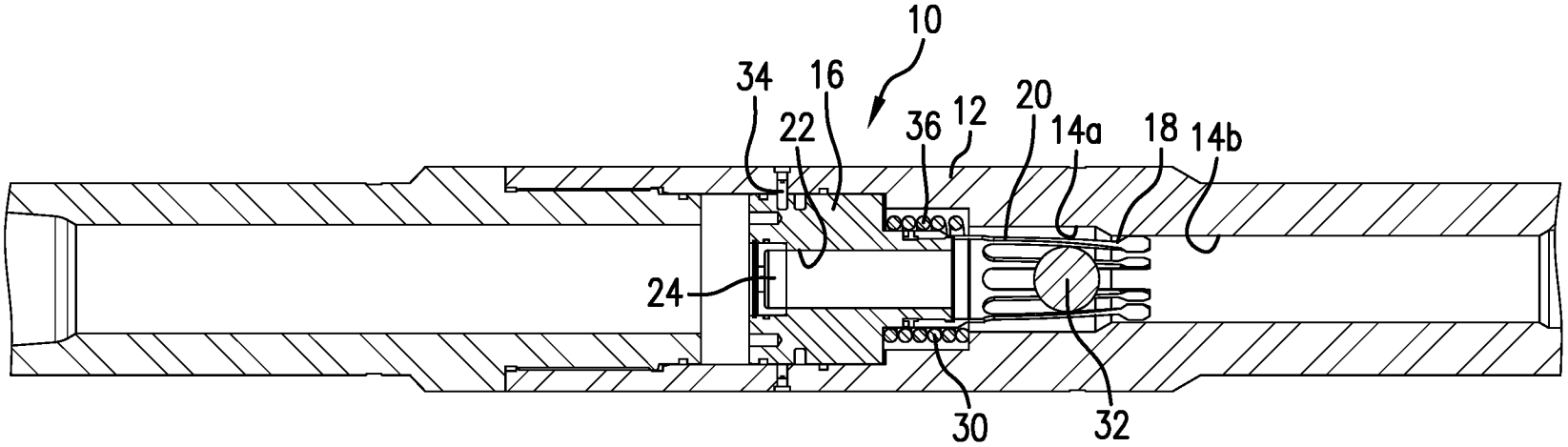
FIG. 2 is the view of FIG. 1 in a pressured position.
Figure 3:
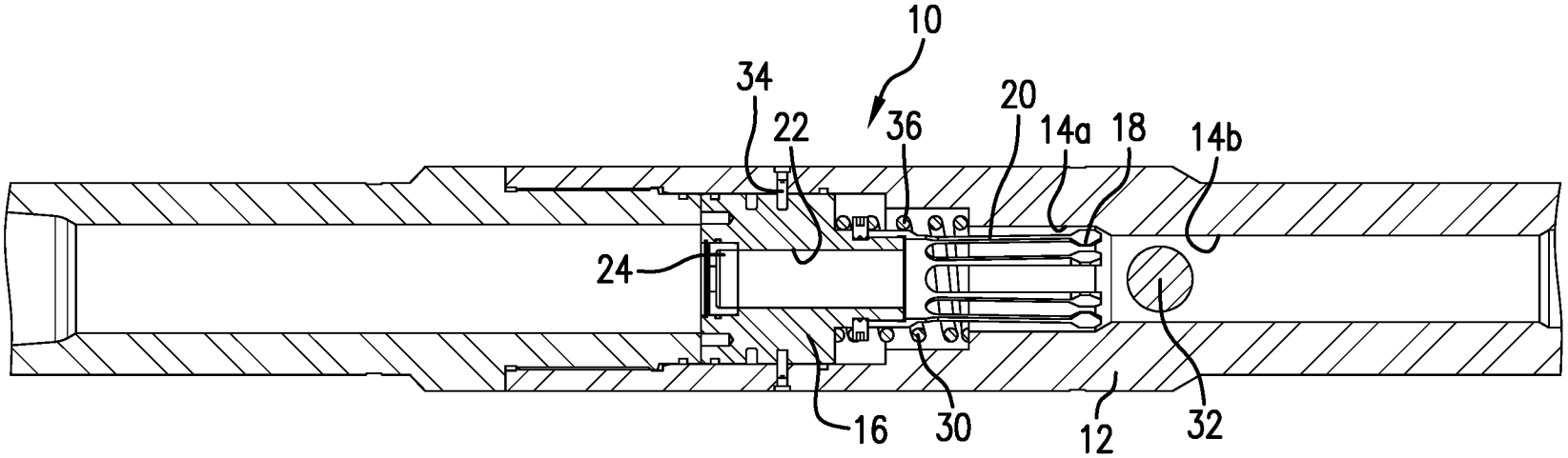
FIG. 3 is the view of FIG. 1 in a shifted position.

Referring to FIGS. 1-3 a sequence of positions from run in to release of an object carrier 10 are illustrated. The carrier 10 includes a housing 12 having a bore 14 with a diametrically larger portion 14*a* and a diametrically smaller portion 14*b*. The housing accepts an actuator assembly 16 configured to move a first end 18 of an object keeper 20 from the diametrically smaller portion 14*b* to the diametrically larger portion 14*a* responsive to selected application of pressure on the actuator assembly 16. The assembly 16 further defines a body bore 22 therethrough with an orifice 24 disposed along the body bore 22. The orifice is configured oppositely to convention in that it is desirable in this configuration to provide for a large diameter but also one that will generate significantly more back pressure when subjected to higher flow rates, than would a conventional well tapered nozzle. In order to accomplish this desired property, the orifice is a "short" nozzle, which is defined as an axial length that is less than or equal to 3 diameters of the bore. In an embodiment, the diameter of the orifice 24 is 1 inch while the axial length of the orifice 24 is 0.25 inch. Further, the orifice 24 is configured with orthogonal entry and exit surfaces. The configuration reduces velocity and discharge coefficients as compared to traditional smooth and well tapered nozzles. This configuration provides for a large diameter opening for flowing larger volumes of fluid therethrough while still achieving a significant back pressure to operate the actuator assembly 16. If a traditional smooth and well tapered nozzle (for example one with a coefficient of discharge of about 0.95) was used the pressure induced by the orifice under the same flow rate would be significantly less, thus limiting the available pressure to operate the actuator assembly 16. In one specific example, the 1.0" diameter orifice noted above with orthogonal entrance and exit faces and with an axial length of 0.25 inches yields a 0.635 coefficient of discharge and produces a back pressure of 491.9 psi (pounds per square inch) at 10.0 bpm (barrels per minute) with water of a specific gravity of 1.0. At 20 bpm through the same orifice, the back pressure would rise to 1,968 psi. In addition, the configuration as disclosed reduces jetting effects normally associated with a nozzle that increases velocity and would have a reduced generation of backpressure. While a high back pressure would normally be undesirable in the downhole environment, in the presently disclosed arrangement, it is valuable since both significant flow volume through the carrier 10 and high actuation pressure may be easily obtained by adjusting flow rate.

Attached to the assembly 16 is the object keeper 20 with its first end 18 and a second end 30, the first end 18 being initially disposed in the diametrically smaller portion 14*b* of the housing 12. In this position, which is a run in position seen in FIG. 1, the keeper 20 is urged toward a position where an object 32 disposed therein cannot escape the keeper 20. In an embodiment, the keeper 20 is configured as a collet. An advantage of configuring the keeper 20 as a collet or other construction that provides for gaps in its structure is that fluid may be flowed past the object 32 while it is still captured in the keeper 20, thereby maintaining fluid communication through the carrier 10 regardless of its current position. This allows for other operations to take place both before and after the object 32 is released from the carrier 10. Movement of the assembly 16 that repositions the end 18 in the diametrically larger portion 14*a*, allows the keeper 20 to naturally expand thereby releasing the object 32 therefrom. Such movement of the assembly 16 is occasioned by increasing a flow rate of fluid flowing through the body bore 22 whereupon the backpressure created by the orifice 24 loads the assembly 16 in the downstream direction.

Figure 4:
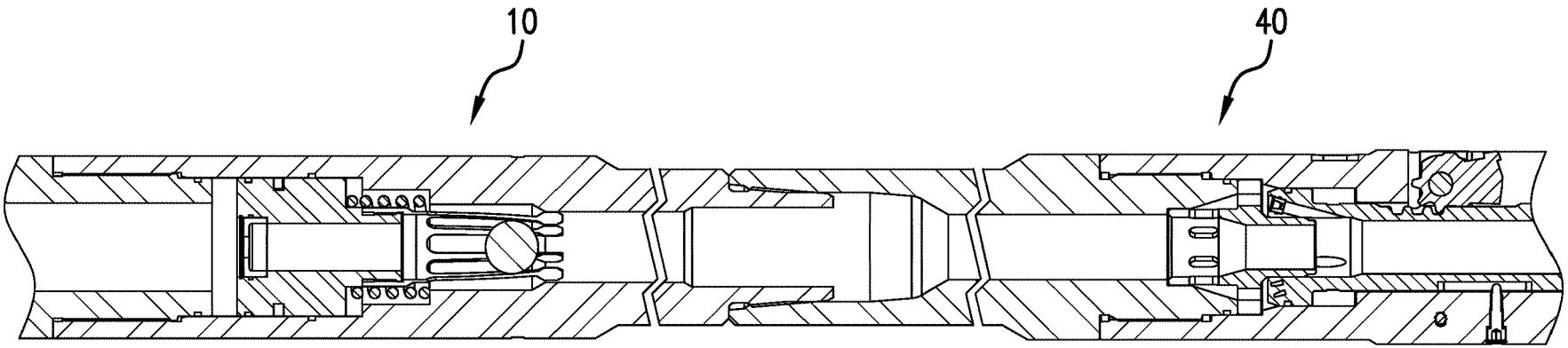
FIG. 4 is a side sectional view of a downhole arrangement including the object carrier of FIG. 1 and a downhole tool; and herein.

Initially, this load of the assembly 16 is resisted by release member 34, which may in some embodiments be a shear screw as shown. Upon the load that the flow and backpressure places on the assembly 16 exceeds a threshold load, that threshold being selected when assembling the assembly 16 by selecting a release member having the desired threshold. When the threshold load is met, the release member 34 releases and the assembly 16 moves in the downhole direction as illustrated in FIG. 2. While the assembly 16 moves downhole, a biaser 36 is compressed. The biaser 36 may be a compression spring in some embodiments. Because the biaser gets compressed by the load and also because the biaser started in compression in the run in position, the reverse stroke of the assembly 16 upon reduction of the fluid applied load is longer than the initial stroke in the downhole direction due to the fluid pressure. This means that the end 18 will exit the diametrically smaller portion 14*b* upon the biaser 36 action following reduction in the fluid flow/pressure on the assembly 16. As noted above, when the end 18 reaches the portion 14*a*, the object 32 is free to exit the keeper 20. Once object 32 exits keeper 20 it proceeds to a tool 40 (see FIG. 4) that is actable based upon the landing of the object 32 on a seat 42 in the tool 40. In one embodiment the tool is a casing cutter as illustrated but it is to be appreciated that any downhole tool that is actuable by an object 32 such as a ball may be substituted for the casing cutter shown. The carrier 10 allows for the actuation of tools in the downhole environment downhole of a restriction of the string above including motors, other restricted diameter features, etc. Prior to this disclosure, actuations of this nature downhole of a restriction using a standard object were essentially impossible to effect.

Figure 5:
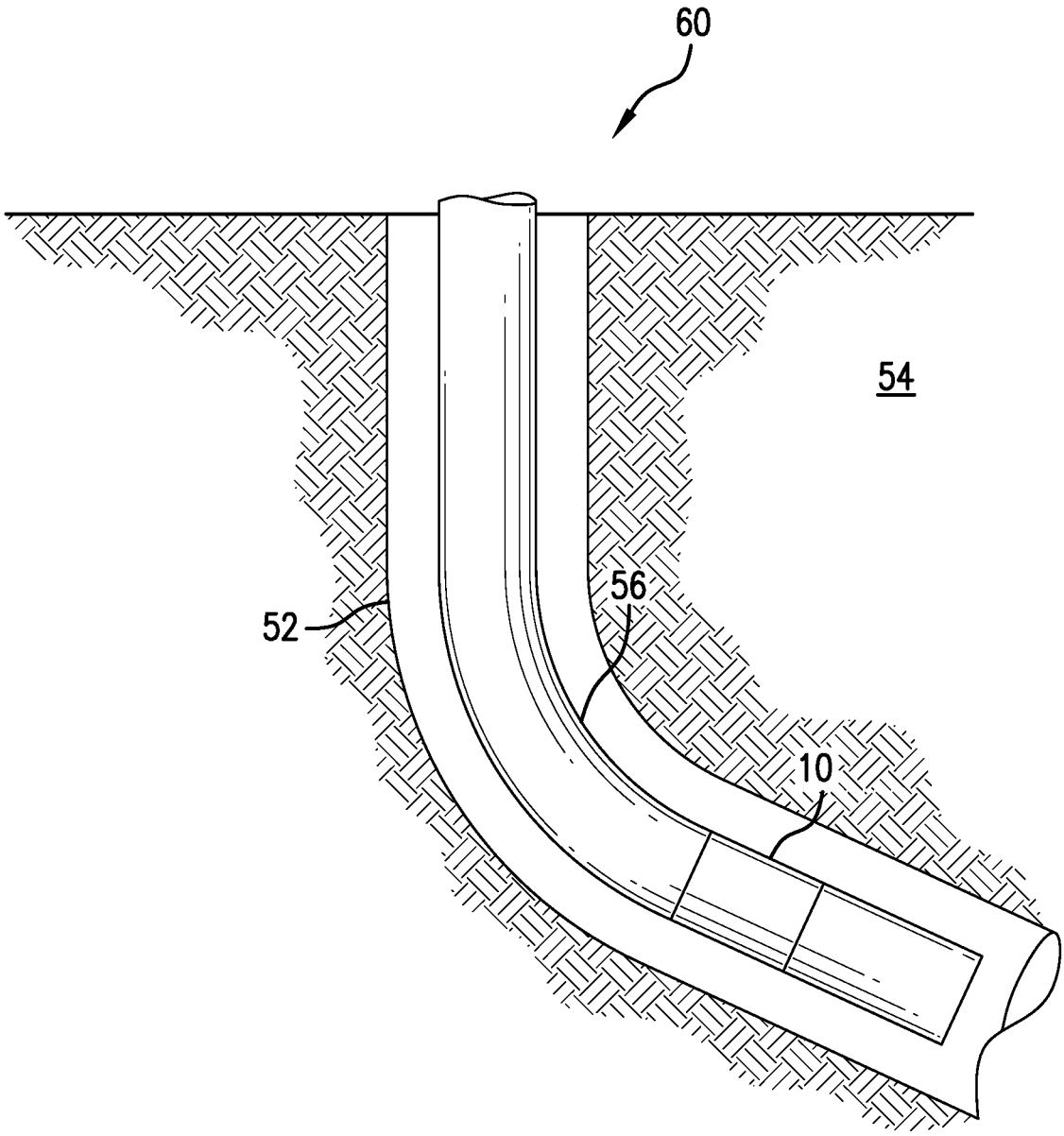
FIG. 5 is a view of a borehole system including the object carrier disclosed herein.

Referring to FIG. 5, a borehole system 50 is illustrated. The system 50 includes a borehole 52 in a subsurface formation 54. A string 56 is disposed in the borehole 52. A carrier 10 as disclosed herein is disposed within or as a part of the string 56. Further, the carrier 10 may be disposed downhole of a restriction in the string 56 that would not permit passage of the object 32 disposed in the carrier 10.

Set forth below are some embodiments of the foregoing disclosure:

Embodiment 1: An object carrier including a housing having a bore with a diametrically larger portion and a diametrically smaller portion, an object keeper having a first and a second end, the first end being initially disposed in the diametrically smaller portion, an actuator assembly configured to move the first end of the object keeper from the diametrically smaller portion to the diametrically larger portion responsive to selected application of pressure, and an object disposed within the object keeper and secured within the object keeper while the first end of the object keeper is in the diametrically smaller portion, the object being released from the object keeper upon the first end of the object keeper moving to the diametrically larger portion.

Embodiment 2: The object carrier as in any prior embodiment wherein the object keeper is configured as a collet.

Embodiment 3: The object carrier as in any prior embodiment wherein the actuator assembly includes a body having a body bore therethrough and an orifice in fluid communication with the body bore.

Embodiment 4: The object carrier as in any prior embodiment wherein the orifice has an axial length of less than three diameters and orthogonal entrance and exit surfaces.

Embodiment 5: The object carrier as in any prior embodiment wherein the actuator assembly is biased relative to the housing by a biaser.

Embodiment 6: The object carrier as in any prior embodiment wherein the actuator assembly includes a release member.

Embodiment 7: The object carrier as in any prior embodiment wherein the object carrier, subsequent to the release of the release member, moves to a second position within the diameter smaller portion prior to moving to the diametrically larger portion.

Embodiment 8: The object carrier as in any prior embodiment wherein the release member is a shear screw.

Embodiment 9: The object carrier as in any prior embodiment wherein the object is a ball.

Embodiment 10: A method for managing an object-based operation downhole of a restriction including pressuring up on the object carrier as in any prior embodiment, withdrawing the first end from the diametrically smaller portion, and releasing the object.

Embodiment 11: The method as in any prior embodiment further including landing the object on a tool to be actuated, and pressuring up to actuate the tool.

Embodiment 12: The method as in any prior embodiment, the method including flowing fluid through the object carrier.

Embodiment 13: The method as in any prior embodiment, wherein the flowing fluid is flowing while the object is disposed in the object keeper.

Embodiment 14: A borehole system including a borehole in a subsurface formation, a string in the borehole, and an object carrier as in any prior embodiment disposed within or as a part of the string.

Embodiment 15: The system as in any prior embodiment wherein the object carrier is disposed further downhole in the string than a restriction in the string smaller than the object.

Embodiment 16: A downhole arrangement comprising the object carrier as in any prior embodiment and a downhole tool actuatable by the object.

Embodiment 17: The arrangement as in any prior embodiment wherein the tool is a casing cutter.

Embodiment 18: The arrangement as in any prior embodiment wherein the casing cutter includes a motor.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, abandonment operations, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An object carrier comprising:

a housing having a bore with a diametrically larger portion and a diametrically smaller portion;

an object keeper having a first and a second end, the first end being initially disposed in the diametrically smaller portion;

an actuator assembly disposed in the housing nearer the diametrically larger portion than the diametrically smaller portion and configured to move the first end of the object keeper from the diametrically smaller portion to the diametrically larger portion responsive to a sequence of selected application of pressure to move the actuator assembly in a first direction and reduction the pressure to move the actuator assembly in a second direction opposite the direction of movement caused by application of the pressure; and an object disposed within the object keeper and secured within the object keeper while the first end of the object keeper is in the diametrically smaller portion, the object being released from the object keeper upon the first end of the object keeper moving to the diametrically larger portion due to the movement of the actuator assembly in the second direction.

2. The object carrier as claimed in claim 1 wherein the object keeper is configured as a collet.

3. The object carrier as claimed in claim 1 wherein the actuator assembly includes a body having a body bore therethrough and an orifice in fluid communication with the body bore.

4. The object carrier as claimed in claim 3 wherein the orifice has an axial length of less than three diameters and is orthogonal to the entrance and exit surfaces.

5. The object carrier as claimed in claim 1 wherein the actuator assembly is biased relative to the housing by a biaser.

6. The object carrier as claimed in claim 1 wherein the actuator assembly includes a release member.

7. The object carrier as claimed in claim 6 wherein the object carrier, subsequent to the release of the release member, moves to a second position within the diameter smaller portion prior to moving to the diametrically larger portion.

8. The object carrier as claimed in claim 6 wherein the release member is a shear screw.

9. The object carrier as claimed in claim 1 wherein the object is a ball.

10. A method for managing an object-based operation downhole of a restriction comprising:

pressuring up on the object carrier as claimed in claim 1;

withdrawing the first end from the diametrically smaller portion; and releasing the object.

11. The method as claimed in claim 10 further comprising:

landing the object on a tool to be actuated; and pressuring up to actuate the tool.

12. The method as claimed in claim 10, the method including flowing fluid through the object carrier.

13. The method as claimed in claim 12, wherein the flowing fluid is flowing while the object is disposed in the object keeper.

14. A borehole system comprising:

a borehole in a subsurface formation;

a string in the borehole; and an object carrier as claimed in claim 1 disposed within or as a part of the string.

15. The system as claimed in claim 14 wherein the object carrier is disposed further downhole in the string than a restriction in the string smaller than the object.

16. A downhole arrangement comprising the object carrier as claimed in claim 1 and a downhole tool actuatable by the object.

17. The arrangement as claimed in claim 16 wherein the tool is a casing cutter.

18. The arrangement as claimed in claim 17 wherein the casing cutter includes a motor.

* * * * *